US006382377B2

(12) United States Patent
Godshaw

(10) Patent No.: US 6,382,377 B2
(45) Date of Patent: May 7, 2002

(54) STORAGE AND TRAVEL BAG

(75) Inventor: Donald E. Godshaw, Evanston, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/811,899

(22) Filed: Mar. 19, 2001

Related U.S. Application Data

(60) Provisional application No. 60/190,193, filed on Mar. 17, 2000.

(51) Int. Cl.[7] ..... A45C 3/00

(52) U.S. Cl. ..... 190/110; 190/109; 190/36; 383/38; 206/817

(58) Field of Search ..... 206/817; 190/109, 190/110, 103, 36; 220/529, 530, 536, 534; 150/183, 112; 383/38, 39, 40

(56) References Cited

U.S. PATENT DOCUMENTS

| | | | | | |
|---|---|---|---|---|---|
| 9,253 | A | * | 6/1852 | Sherriff | 190/36 |
| 728,524 | A | * | 5/1903 | Walter | 190/36 |
| 972,323 | A | * | 10/1910 | Bogen | 190/36 |
| 2,628,694 | A | * | 2/1953 | Kushner | 190/109 X |
| 5,524,754 | A | * | 6/1996 | Hollingsworth | 190/111 X |
| D401,062 | S | * | 11/1998 | Hauschild | D3/287 |
| 5,857,568 | A | * | 1/1999 | Speirs | 190/110 X |
| 6,105,764 | A | * | 8/2000 | Scicluna et al. | 190/111 X |

* cited by examiner

*Primary Examiner*—Lee Young
*Assistant Examiner*—Tri M. Mai
(74) *Attorney, Agent, or Firm*—Banner & Witcoff, Ltd.

(57) ABSTRACT

A storage travel bag has a generally parallel-piped shape and includes an internal retention panel system comprising a retention panel with elastic straps or ribbons that enable the retention panel to compress an item and hold it in position in a desired manner within the bag.

10 Claims, 4 Drawing Sheets

STORAGE AND TRAVEL BAG

CROSS REFERENCE TO RELATED APPLICATION

This is a utility application based on U.S. Provisional Application Ser. No. 60/190,193 filed Mar. 17, 2000, which is incorporated herewith by reference.

BACKGROUND OF THE INVENTION

In a principal aspect the present invention relates to a storage and travel bag especially useful for holding an item within the bag such as a camera and restraining that item relative to the remainder of the contents of the bag.

When traveling, hiking or the like, it is often desirable and necessary to carry bulky but fragile items that must be protected in a carrying case or bag. Further, it is often necessary to place numerous items within a carrying case or bag yet provide a means or mechanism to maintain certain items securely in a fixed position in the bag. Various means have been proposed to address these needs. Most typically bags which incorporate cushioning material are provided. Alternatively, the items are wrapped in cushioning material and placed within a bag. Nonetheless there has remained the need to provide for improved bag constructions for carrying items and providing a mechanism or means for protection of the items carried within the bag.

SUMMARY OF THE INVENTION

Briefly the present invention comprises a storage and travel bag having a generally parallel-piped shape and further including panels defining the enclosed parallel-piped bag with an interior retention or restraining system for holding an item. The retention or restraining system includes an interior retention panel supported by elastic straps or ribbons which serve to tightly compress or hold the item within the bag in a retained or fixed position. The opposite ends of the bag includes pouches into which items such as clothing may be placed for purposes of storage but also the purpose of acting as a cushioning feature of the bag. The retention system may optionally be removable from the bag. In a preferred embodiment, the elastic straps are positioned in combination with a flexible panel (typically fabric) to form a collapsible pocket that will facilitate retention of an item by means of the retention panel. The bag is especially useful as a camera case inasmuch as the camera or similar item to be protected may be positioned within the part of the bag comprising the retention panel and elastic straps.

Thus it is the object of the invention to provide an improved travel and storage bag construction.

It is the further object of the invention to provide an improved storage and travel bag which protects the contents retained in the bag such as a camera or similar item by restraining the item in a compartment with elastic straps, a retention panel and an encapsulating flexible fabric cover or sheet.

A further object of the invention is to provide an improved travel and storage bag which is easy to carry, which fits into airline overhead or under the seat compartments, which is inexpensive, rugged, and economical.

These other objects, advantages, and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
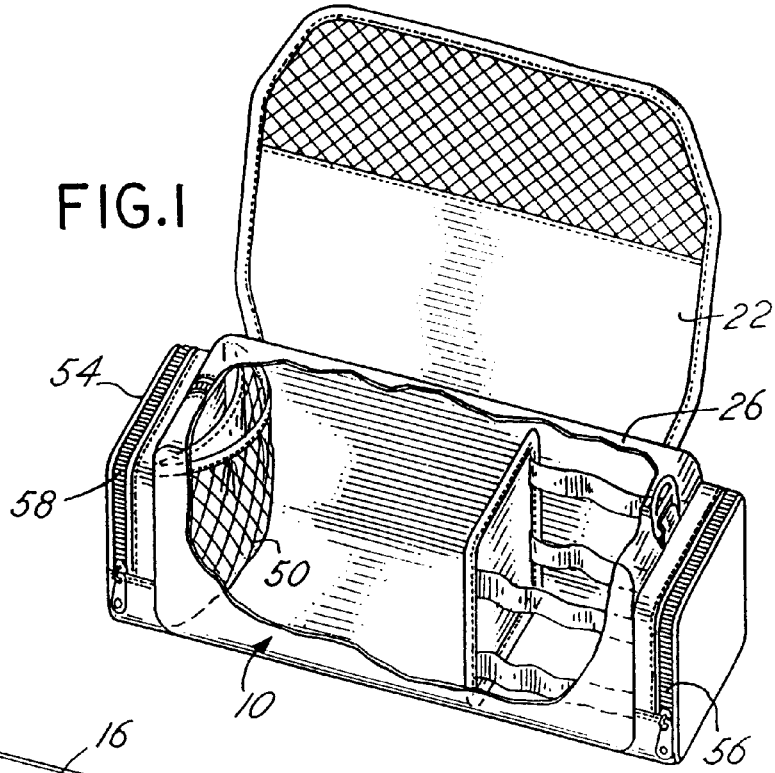
FIG. 1 is an isometric, cutaway view of the storage and travel bag of the invention.

Referring to the figures, the storage and travel bag comprises a generally parallelepiped bag 10 having a bottom panel 12, a first end panel 14, and opposed, spaced, parallel, opposite second end parallel 16, a first or front side panel 18, a back side panel 20 and a closure flap 22 and a top panel 26. Front panel 18 and back panel 20, along with bottom panel 12 form an enclosure in combination with the first and second end panels 14 and 16. Typically, the enclosure includes a means for access to the interior of the enclosure. A typical means for access includes a zipper 24 which opens the top panel 26.

A camera, for example, may be positioned within the enclosure for retention by a retention system. The retention system includes an internal retention panel 28 which has a shape and configuration generally congruent with the shape and configuration of end panel 16. The retention panel 28 is attached to the end panel 16 by means of four elastic straps 30, 32, 34 and 36. Elastic straps 30 and 32 are attached to one vertical side 38 of the retention panel 28 and to a corresponding side of end panel 16. Elastic straps or ribbons 34 and 36 are similarly positioned and engage the opposite side 40 of the retention panel 28 and connect to the corresponding side of the end panel 16. The elastic straps 34 and 36 are spaced one above the other. Similarly, elastic straps 30 and 32 are spaced one above the other. The elastic straps 30 and 32 are spaced one above the other and against the front panel 18 or back panel 20 so they will not interfere with placement of an item between panels 28 and 16. The elastic straps 30, 32, 34 and 36 all have a common or uniform length. Thus, as the straps 30, 32, 34, 36 are stretched or expanded, they impart a uniform force on an item which is retained between retention panel 28 and end panel 16. Ribbons or elastic straps on a cloth or fabric panel may be formed to connect the bottom sides 41, 43 of panel 28 and end panel 16.

Figure 4:
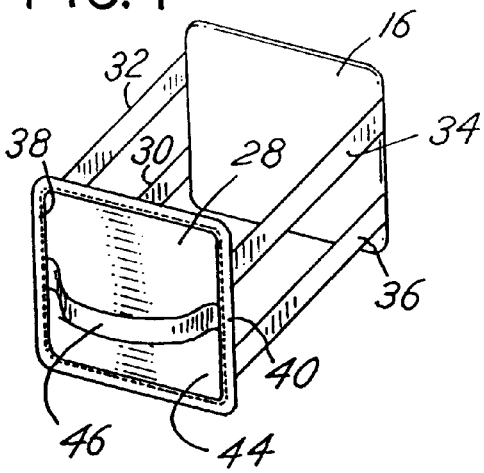
FIG. 4 is an isometric view of the retention system associated with the storage and travel bag.
Figure 3:
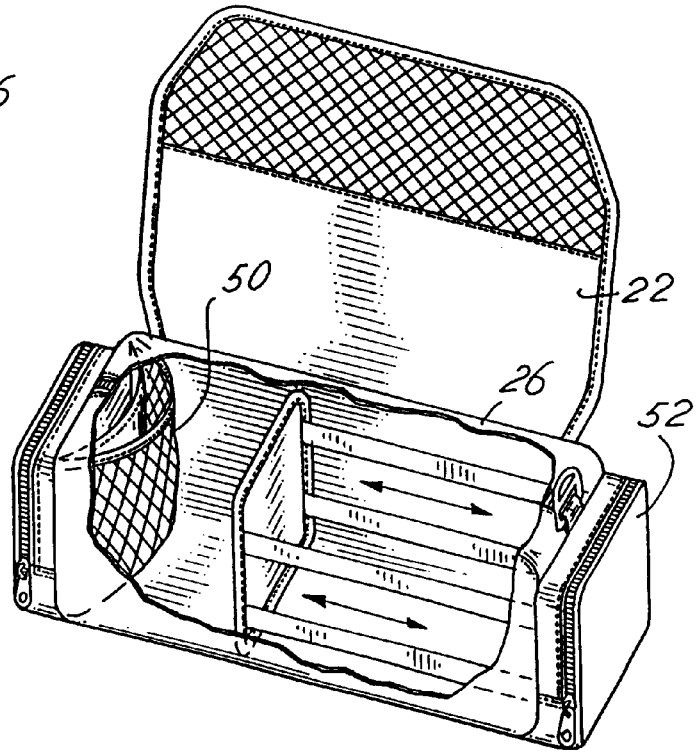
FIG. 3 is an isometric view similar to FIG. 2.
Figure 2:
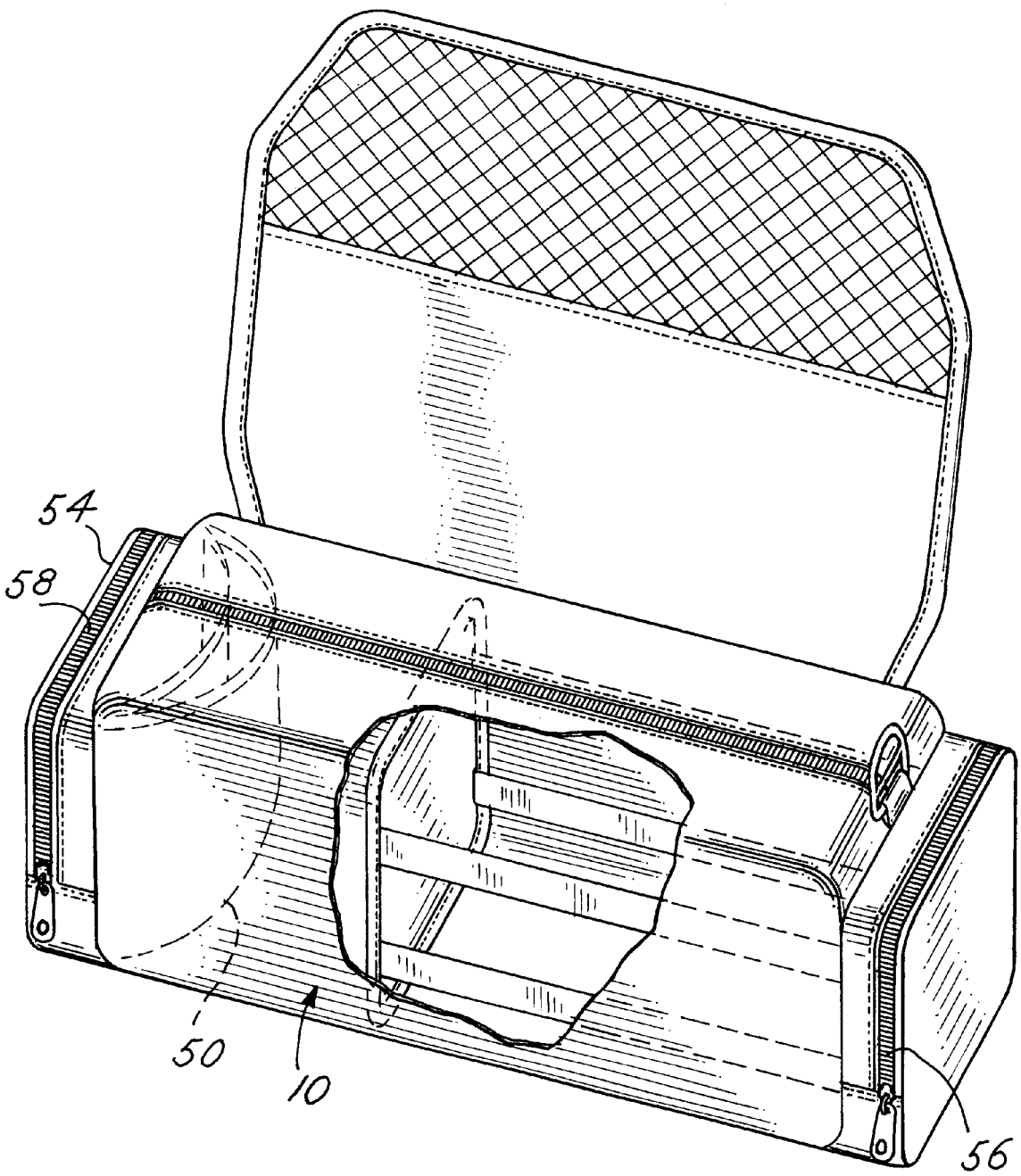
FIG. 2 is an isometric, cutaway view similar to FIG. 1 wherein a restraining or retaining system for the camera in the storage and travel bag is in an elastically extended position.
Figure 5:
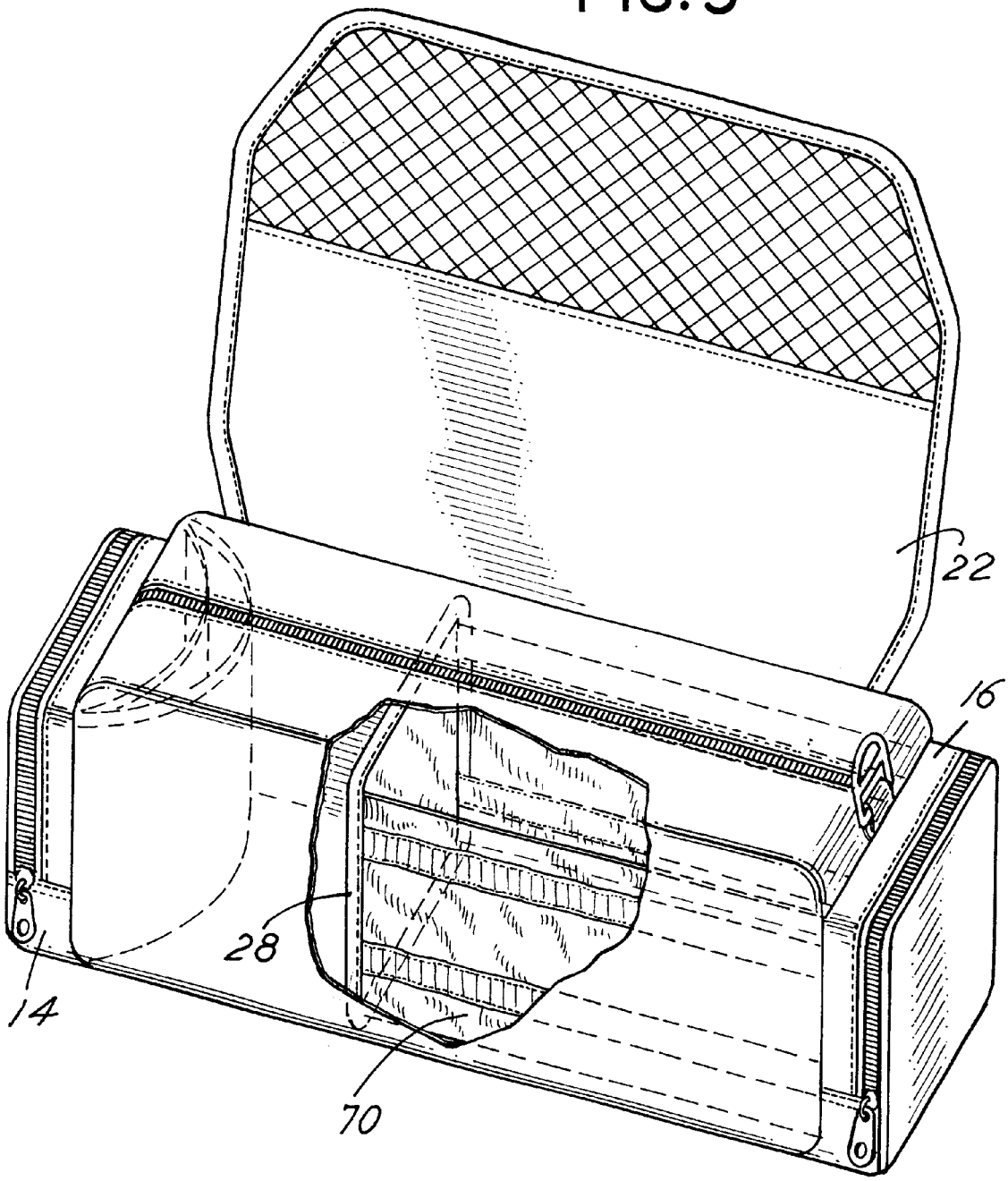
FIG. 5 is an isometric view of an alternative embodiment which incorporates a fabric pocket.
Figure 8:
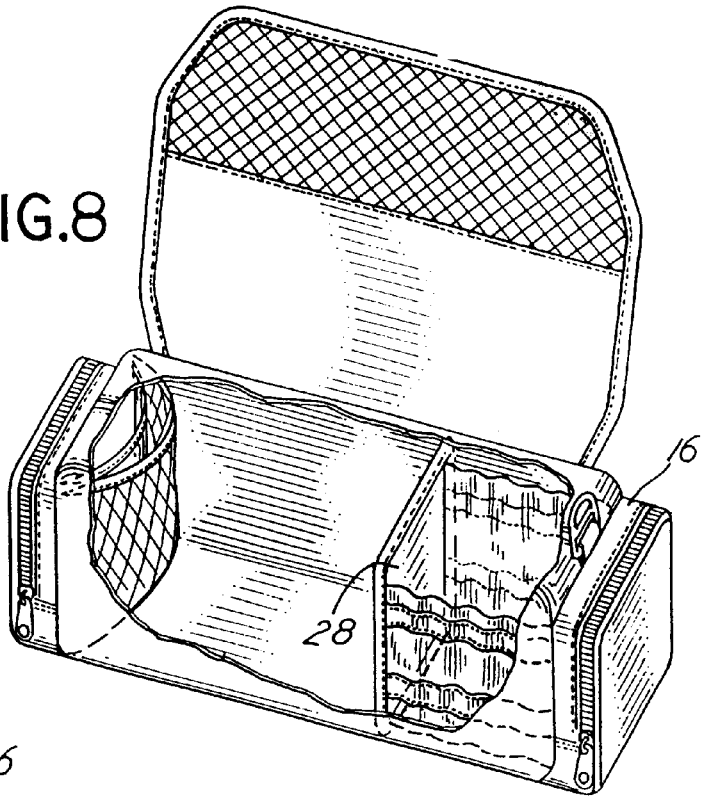
FIG. 8 is an isometric view of the embodiment of FIG. 5 illustrating the collapsed pocket of the retention system.
Figure 7:
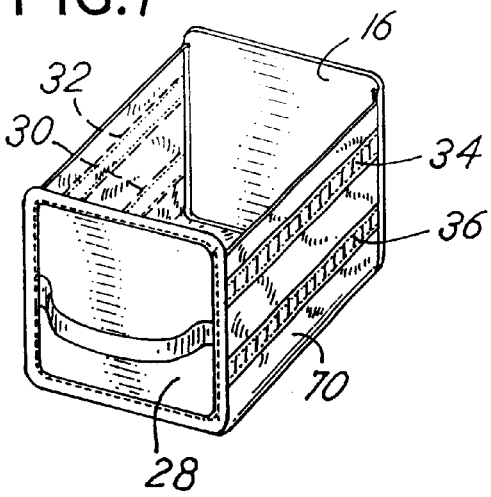
FIG. 7 is an isometric view of the retention system of FIG. 6 removed from the bag.
Figure 6:
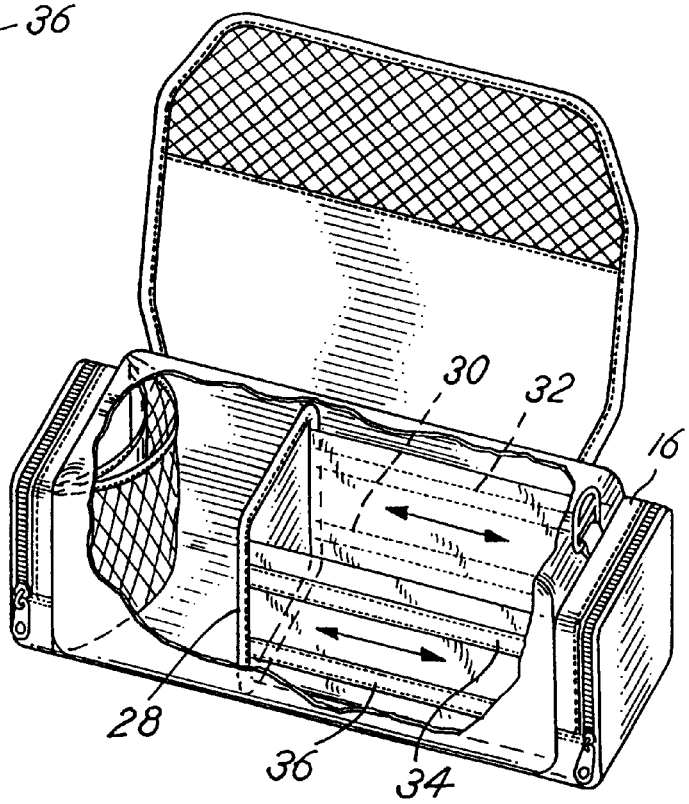
FIG. 6 is an isometric view of the embodiment of FIG. 5 wherein the retention system is depicted with a fabric pocket.

As shown in FIG. 4, the retention end panel 28 includes an outside face 44 with a fabric handle 46 connected between sides 38 and 40. The handle 46 may thus be manually engaged so as to stretch the straps 30, 32, 34 and 36 and displace the retention panel 28 from the panel 16 to permit insertion of a camera or other item there between. An item (not shown) may thus be retained between retention panels 28 and end panel 16 in a safe and tightly engaged manner so that the carrying case may serve to protect and hold the camera in a fixed, tight position.

The bag of the invention typically includes an internal storage pouch 50 made from an elastic or fabric material within the interior of the case or bag in opposed relation to the retention panel 28. The storage pouch 50 is useful for the storage of items such as film and other photographic materials. Optional additional pouches or pockets 52 and 54 having zippers 56 and 58 provide for additional storage. The pockets 52 and 54 are positioned over the end panels 16 and 14, respectively. The flap 22 folds over the top panel 26 and includes an optional fastener for retention over the top panel 26 and for attachment to side panel 12 so as to further protect the contents of the enclosure or bag.

The retention system comprising the panel 28 and panel 16 along with the elastic straps 30, 32, 34 and 36 may be fabricated so as to be removable from the bag. That is, the backside of the panel 16 may include a fastening system such as Velcro fastening system for attachment to the inside end of the bag enclosure. In this manner, an item may be positioned between the panels 28 and 16 and elastically compressed therebetween. Then, it may be inserted within the enclosure defined by the various panels.

FIGS. 5 through 8 depict an alternative embodiment of the invention wherein the retention pocket, provided to hold and retain an item such as a camera, includes a pocket formed by a fabric panel 70 which connects or is attached to the retention panel 28 at one side and the first end panel 16 at the opposite side. That is, the fabric panel 70 is sewn or attached to the retention panel 28 and to the first end panel 16. The flexible fabric panel 70 extends along three sides of the retention panel 28 and first end panel 16, i.e. the bottom and sides thereof, to define, in essence, a pocket accessible through the top thereof and into which an item such as a camera may be positioned. The elastic straps 30, 32, 34, and 36 depicted in phantom in FIGS. 5 through 8 still connect between the retention panel 28 and the end panel 16. However, the elastic straps 30, 32, 34, and 36 may be sewn to the sides of the fabric panel 70 on the inside or outside thereof. Alternatively, straps 30, 32, 34, 36 may be connected between retention panel 28 and end panel 16 without the attachment to the flexible, fabric panel 70. Still another alternative is that the panel 70 may, in fact, comprise an inner and an outer layer of fabric with the elastic straps positioned between the inner and the outer layers. Yet another alternative provides that the elastic straps 30, 32, 34, and 36 are retained in sleeves that are attached to the fabric panel 70 or the panel 70 may be elastic. In any event, the function of the straps 30, 32, 34, and 36 remains; namely, to pull or compress the panel 28 toward the first end panel 16 thereby providing a means to retain an item in the pocket or compartment formed within the bag.

The storage and travel bag retention system is a storage and containment device that can be placed or incorporated into any type of bag. In a preferred embodiment, it serves as a camera case. However, it may be included within a duffle bag or other case or luggage to facilitate maintaining the item stored there and distributed appropriately within the case or container. That is, a number of the storage bag containment or retention systems of the type described may be incorporated and stacked within the interior of a case. They will then keep the contents thereof separated and stored in a manner which enhances transport without damage. The case or bag thus precludes the contents or items within the larger case from shifting or spilling.

Various other features of the storage bag may be provided without departing from the spirit and scope of the invention. Additional pouches, closure means and the like, may be included. Thus, the invention is to be limited only by the following claims and equivalents thereof.

What is claimed is:

1. A storage and travel bag comprising, in combination:

a generally parallelepiped bag having an enclosure defined by a bottom panel, a first end panel, a spaced second end panel, a front panel, a back panel and a top panel;

an ingress to the enclosure;

an internal retention panel generally congruent in shape and size to said first end panel and spaced from said first end panel;

a plurality of elastic straps connecting the retention panel to the first end panel to define a retaining pocket for an item with the elastic straps drawing the retention panel toward the first end panel to tightly retain an item between the retention panel and first end panel.

2. The bag of claim 1 wherein the top panel defines a flap for ingress to the enclosure.

3. The bag of claim 1 wherein the end panels each have an outside face and a pocket enclosure is formed on at least one outside face.

4. The bag of claim 1 wherein the enclosure further includes a storage pouch intermediate the retention panel and the second end panel.

5. The bag of claim 1 wherein the elastic straps each comprise a first elastic ribbon adjacent the front panel and a second elastic ribbon adjacent the back panel.

6. The bag of claim 5 wherein the retention panel and first end panel are quadrilateral panels.

7. The bag of claim 1 wherein the end panels and retention panel are congruent.

8. The bag of claim 1 including an interior panel detachable from the first end panel and wherein the retention panel is connected by the elastic straps to the interior panel, said interior panel and retention panel being removable from the bag.

9. The bag of claim 1 or 8 wherein the retention panel has an outside face and including a handle on the retention panel outside face.

10. The bag of claim 1 further including a flexible fabric connected between the retention panel and the first end panel, said fabric extending around three sides of the retaining pocket formed between the first end panel and retention panel.

* * * * *